US010187738B2

(12) United States Patent
Ajmera et al.

(10) Patent No.: US 10,187,738 B2
(45) Date of Patent: Jan. 22, 2019

(54) SYSTEM AND METHOD FOR COGNITIVE FILTERING OF AUDIO IN NOISY ENVIRONMENTS

(71) Applicant: International Business Machines Corporation, Armonk, NY (US)

(72) Inventors: Jitendra Ajmera, New Delhi (IN); Nitendra Rajput, Gurgaon (IN); Saurabh Srivastava, Bengaluru (IN); Shubham Toshniwal, New Delhi (IN)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 78 days.

(21) Appl. No.: 14/699,391

(22) Filed: Apr. 29, 2015

(65) Prior Publication Data

US 2016/0323666 A1 Nov. 3, 2016

(51) Int. Cl.
*H04S 7/00* (2006.01)
*H04R 3/00* (2006.01)
(Continued)

(52) U.S. Cl.
CPC ..... *H04S 7/30* (2013.01); *G10K 11/34* (2013.01); *H04R 3/005* (2013.01); *H04R 5/033* (2013.01);
(Continued)

(58) Field of Classification Search
CPC ..... G06F 3/167; G06F 3/017; G06F 3/041; G10L 19/00; G10L 21/00; H04R 3/005; H04R 3/00; H04R 1/1083; H04R 2420/07; H04R 1/08; H04R 2410/05; H04R 2201/403; H04R 5/04; H04R 5/033; H04R 25/552; H04R 25/505; H04R 25/554; H04R 25/407; H04R 2225/61; H04R 2225/67; H04R 2460/01; H04S 2400/03;
(Continued)

(56) References Cited

U.S. PATENT DOCUMENTS

2009/0076825 A1* 3/2009 Bradford ..... H04R 25/552 704/271
2011/0125063 A1* 5/2011 Shalon ..... A61B 5/0006 600/590
(Continued)

OTHER PUBLICATIONS

Aichner, Robert, et al., "A real-time blind source separation scheme and its application to reverberant and noisy acoustic environments", Signal Processing 86, 2006, pp. 1260-1277, Multimedia Communications and Signal Processing, University of Erlangen-Nuremberg, Cauerstr. 7, 91058, Erlangen, Germany. Available at www.ElsevierComputerScience.com.
(Continued)

*Primary Examiner* — Yogeshkumar Patel
(74) *Attorney, Agent, or Firm* — Ference & Associates LLC

(57) ABSTRACT

Methods and arrangements for filtering audio in a noisy environment involving receiving audio input at a user's location, using a plurality of audio input devices in proximity with a user. The audio is then separated into sources in response to a user selection. After the selection is made, the amplitudes of the audio sources are adjusted based on the selection. Other variants and embodiments are broadly contemplated herein.

20 Claims, 5 Drawing Sheets

(51) Int. Cl.
*H04R 5/033* (2006.01)
*H04R 5/04* (2006.01)
*G10K 11/34* (2006.01)

(52) U.S. Cl.
CPC ..... *H04R 5/04* (2013.01); *H04R 2201/403* (2013.01); *H04S 2400/09* (2013.01)

(58) Field of Classification Search
CPC .... H04S 2400/15; H04S 2400/09; H04S 7/30; H04S 7/304; H04S 1/005; H04S 7/302; H04S 2420/01; A61B 5/0006; G10K 11/178; G10K 11/17823; G10K 2210/1081; G10K 2210/3028; G10K 2210/12; G10K 2210/1282; G10K 2210/3222
USPC ..... 381/300, 74, 57, 71.1, 94.1, 302, 309, 381/122, 18; 600/590; 704/233, 704/E15.039, E21.002, 271; 367/129
See application file for complete search history.

(56) References Cited

U.S. PATENT DOCUMENTS

2011/0196519 A1 8/2011 Khoury et al.
2012/0051561 A1* 3/2012 Cohen ..... G10L 21/00 381/122
2012/0224456 A1* 9/2012 Visser ..... G01S 3/8006 367/127
2013/0315402 A1* 11/2013 Visser ..... G10L 19/00 381/18
2014/0119581 A1* 5/2014 Tsingos ..... H04S 3/008 381/300
2016/0019026 A1* 1/2016 Gupta ..... G06F 3/167 704/233

OTHER PUBLICATIONS

Wilson, Jeff, et al., "SWAN: System for Wearable Audio Navigation", 11th IEEE International Symposium on Wearable Computers, Oct. 11-13, 2007, pp. 91-98, IEEE Digital Library.
Marentakis, Georgios, et al., "A Study on Gestural Interaction with a 3D Audio Display", Lecture Notes in Computer Science, 2004, 13 pages, Glasgow Interactive Systems Group, Department of Computing Science, University of Glasgow, Glasgow, UK, Glasgow ePrints Service.
Ferrucci, D.A., "Introduction to "This is Watson"", IBM J. Res. & Dev., May/Jul. 2012, 15 pages, IBM, vol. 56, No. 3/4, Paper 1, IBM.

* cited by examiner

SYSTEM AND METHOD FOR COGNITIVE FILTERING OF AUDIO IN NOISY ENVIRONMENTS

BACKGROUND

As is generally known, human interaction, specifically talking to others, is a large portion of the human experience, and is generally a requirement for navigating a typical day. Listening to others speak is a major method of information transmission between humans. Generally, people enjoy the ease and flexibility of an open dialogue with other human beings as a form of information gathering over reading informational content. Audio (e.g., speech) is a simple, quick, and natural means of sending and receiving information.

However, the increasing number of sources for information (e.g., a noisy environment) can create an information overload or cause information confusion. Not only is it difficult to receive a communication in a noisy environment, but it can also be difficult to process the information being received. The ability to control what audio source is heard and even enhance the selected audio source would not only help people navigate complex and noisy environments, but would also improve the general human experience. Thus, a need exists to not only allow users to filter out extraneous background noise, but also focus on and directly highlight an individual audio source.

BRIEF SUMMARY

In summary, one aspect of the invention provides a method of filtering audio in a noisy environment, said method comprising: utilizing at least one processor to execute computer code that performs the steps of: receiving, using a plurality of audio input devices in proximity with a user, audio at the user location generated by a plurality of sources; and separating the audio into the sources in response to a user selection.

Another aspect of the invention provides an apparatus for filtering audio in a noisy environment, said apparatus comprising: at least one processor; a plurality of audio input devices; and a computer readable storage medium having computer readable program code embodied therewith and executable by the at least one processor, the computer readable program code comprising: computer readable program code that receives, using a plurality of audio input devices in proximity with a user, audio at the user location generated by a plurality of sources; and computer readable program code that separates the audio into the sources in response to a user selection.

An additional aspect of the invention provides a computer program product for filtering audio in a noisy environment, said computer program product comprising: a computer readable storage medium having computer readable program code embodied therewith, the computer readable program code comprising: computer readable program code that receives, using a plurality of audio input devices in proximity with a user, audio at the user location generated by a plurality of sources; computer readable program code that separates the audio into the sources in response to a user selection.

A further aspect of the invention provides a method comprising: receiving, using a plurality of audio input devices in proximity with a user, audio at the user location generated by a plurality of sources; separating the audio into the sources in response to a user selection; receiving at least one additional audio input from at least one additional audio source; separating the additional audio into the additional source in response to a user selection; and adjusting, based on the selection, an amplitude of the audio sources.

For a better understanding of exemplary embodiments of the invention, together with other and further features and advantages thereof, reference is made to the following description, taken in conjunction with the accompanying drawings, and the scope of the claimed embodiments of the invention will be pointed out in the appended claims.

DETAILED DESCRIPTION

Figure 1:
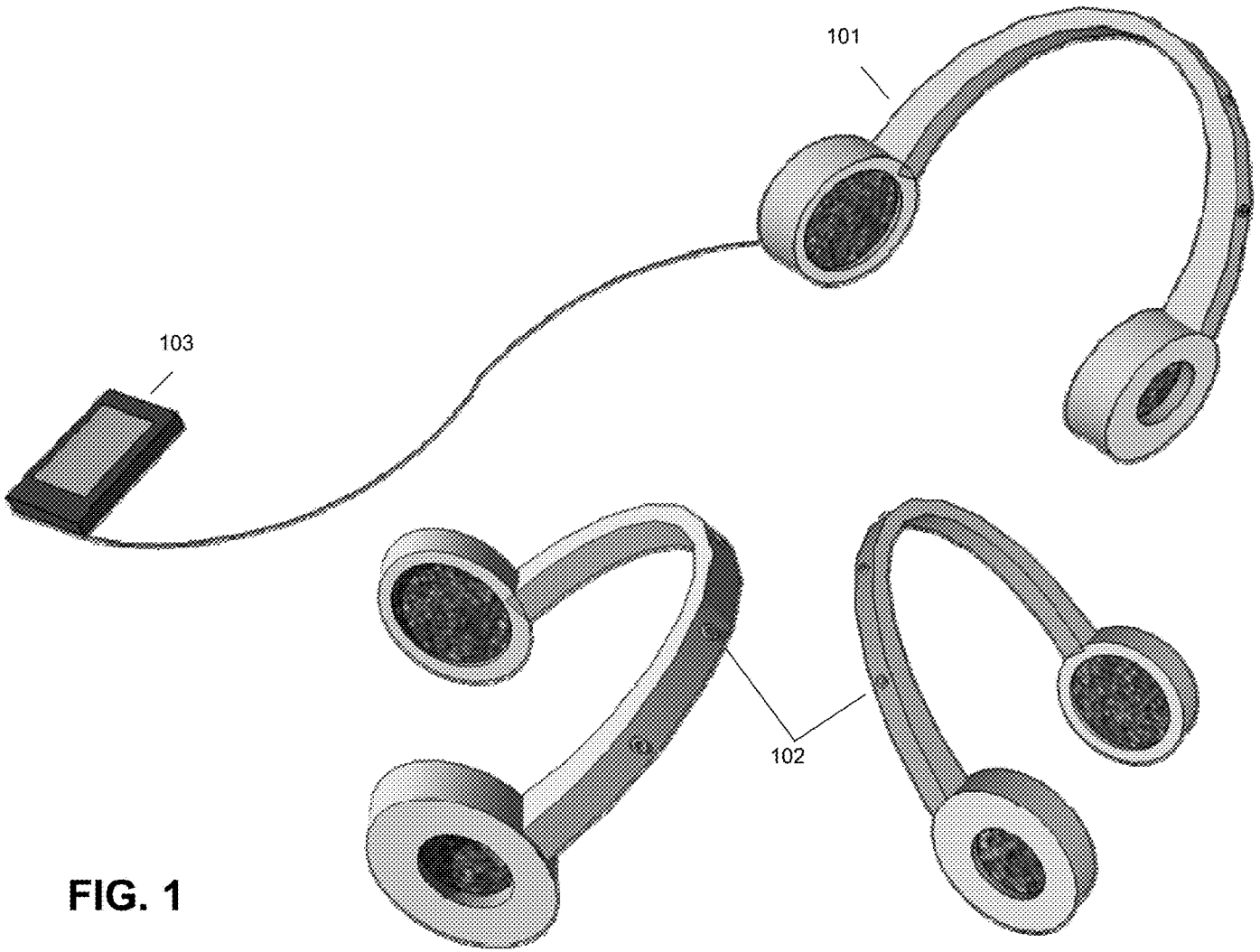
FIG. 1 illustrates an example embodiment comprising a microphone array attached to noise cancelling headphones and a mobile device.

It will be readily understood that the components of the embodiments of the invention, as generally described and illustrated in the figures herein, may be arranged and designed in a wide variety of different configurations in addition to the described exemplary embodiments. Thus, the following more detailed description of the embodiments of the invention, as represented in the figures, is not intended to limit the scope of the embodiments of the invention, as claimed, but is merely representative of exemplary embodiments of the invention.

Reference throughout this specification to "one embodiment" or "an embodiment" (or the like) means that a particular feature, structure, or characteristic described in connection with the embodiment is included in at least one embodiment of the invention. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in at least one embodiment. In the following description, numerous specific details are provided to give a thorough understanding of embodiments of the invention. One skilled in the relevant art may well recognize, however, that embodiments of the invention can be practiced without at least one of the specific details thereof, or can be practiced with other methods, components, materials, et cetera. In other instances, well-known structures, materials, or operations are not shown or described in detail to avoid obscuring aspects of the invention.

Generally, a static graphical user interface (GUI) allows the reader to operate at his or her own pace. This static nature allows a person to take as much time as he or she requires to: read it, understand it, digest it, and even read it again if necessary. Thus, the written word as a method of information transfer is very reliable. However, many people prefer to receive information or communication in auditory format. Unfortunately, the linear nature of an audio modality can make it very difficult for a person to navigate and retrieve all of the relevant and necessary information.

Another limiting factor arises when an audio transfer method experiences interference. Generally, most of the audio based interactions (e.g., human conversations) are subjected to extraneous noise such as that of a noisy restaurant or train station. Because of this extraneous noise, it can be difficult to fully receive and interpret an intended communication. The loudness of a typical environment in combination with the range of sources and content creates a need for a user to filter out the unwanted noise and focus on the desired content and what it is intending to convey. With this type of improvement, the audio transfer of information could become more effective and reliable.

This technical issue presents problems for a user in that the user may be unable to hear and comprehend audio. Currently, a user can employ the use of noise cancelling headphones to reduce the overall nose of an environment. However, this only grants the ability to selectively listen to audio content that was predetermined to be provided to the user (e.g., music, audio from a video source, audio books, etc.). What is missing from the existing solutions is the ability to receive environmental audio while filtering out the external sounds of the environment. If a solution existed that could receive all the sounds of an environment, separate that noise into audio data and associate it with the audio source, and then attenuate the background noise (e.g., all audio data that the user doesn't wish to receive), it would greatly improve the ability to transfer information using an audio modality.

Accordingly, an embodiment provides a method of receiving audio input from multiple sources (e.g., a crowded train platform with many people talking) Once the audio is received, an audio separator breaks up the audio based on the determined source. This processing can be preformed via multiple methods and will be discussed in detail in the following paragraphs. Once all of the environmental audio is received, the signals are separated into individual audio streams. This allows the user to select certain audio streams in order to focus his or her attention, by attenuating the remaining audio sources. This could be a single audio stream (e.g., a single speaker at a banquet) or it could be multiple audio streams (e.g., the guitar, bass, drummer, and singer of a performing musical act).

The description now turns to the figures. The illustrated embodiments of the invention will be best understood by reference to the figures. The following description is intended only by way of example and simply illustrates certain selected exemplary embodiments of the invention as claimed herein.

Specific reference will now be made here below to the figures. It should be appreciated that the processes, arrangements and products broadly illustrated therein can be carried out on, or in accordance with, essentially any suitable computer system or set of computer systems, which may, by way of an illustrative and non-restrictive example, include a system or server such as that indicated at 12' in FIG. 4. In accordance with an exemplary embodiment, most if not all of the process steps, components and outputs discussed with respect to FIGS. 1 and 2 can be performed or utilized by way of a processing unit or units and system memory such as those indicated, respectively, at 16' and 28' in FIG. 4, whether on a server computer, a client computer, a node computer in a distributed network, or any combination thereof.

Broadly contemplated herein, in accordance with at least one embodiment of the invention are methods and arrangements which receive, separate, filter, and playback audio signals. This may involve a cognitive agent which receives complex noisy audio input and separates the received audio into individual audio streams based on the source. The cognitive agent may then determine, based on a variety of factors, which stream the user desires to focus on (i.e., receive more clearly). The individual audio streams are then attenuated or amplified based on the factors and sent to an audio output device for delivery to the user.

In accordance with at least one embodiment of the invention, it is recognized that audio data received at a microphone can be noisy. Noisy audio data can be any audio that contains more than one audio source. An audio stream can be any measurable source of audio (e.g., voice, traffic, wind, etc.); thus any perceivable sound can be deemed an audio stream. By way of example, it may be that only one person is speaking while there is heavy machinery being operated in close proximity. Although there is only one voice audio stream, each piece of machinery creates a separate audio stream. This abundance of audio makes it difficult for the single voice to be heard above the other "noise."

As shown in FIG. 1, an embodiment may use an audio device which may be capable of acoustically isolating a user from the surrounding environmental content (e.g., noise cancelling headphones) at 101. Additionally, an embodiment may include a microphone array at 102. The microphone array can be composed of any number of microphones greater than two. In an embodiment, the microphone array may be located on the noise cancelling headphones as shown at 102. Additionally or alternatively, the array may also be located on the user (e.g., any wearable tech) or on a device (e.g., smartphone, tablet, laptop, etc.) that is in proximity with the user. The microphone array may consist of omnidirectional microphones, directional microphones or a mixture of the two.

In a further embodiment, a mobile device (e.g., smartphone, tablet, etc.) at 103 may be used to receive, process, select, and output the desired audio. By way of example, a smartphone may be connected to a pair of noise cancelling headphones that contain the microphone array (as shown). In an embodiment, the audio is received at the microphone array that is located on the headphones, transmitted to the mobile device where a software application separates and processes the audio before sending it to the noise cancelling headphones for output to a user. Alternatively, the microphone array may be located on the device 103, for example, a tablet device with a plurality of microphones (e.g., a microphone array) operatively coupled to the tablet. In this embodiment, the audio is received, separated, and processed at the device. The only function required of the headphones is the output of the desired audio to a user, thus any typical headphones would suffice.

Figure 2:
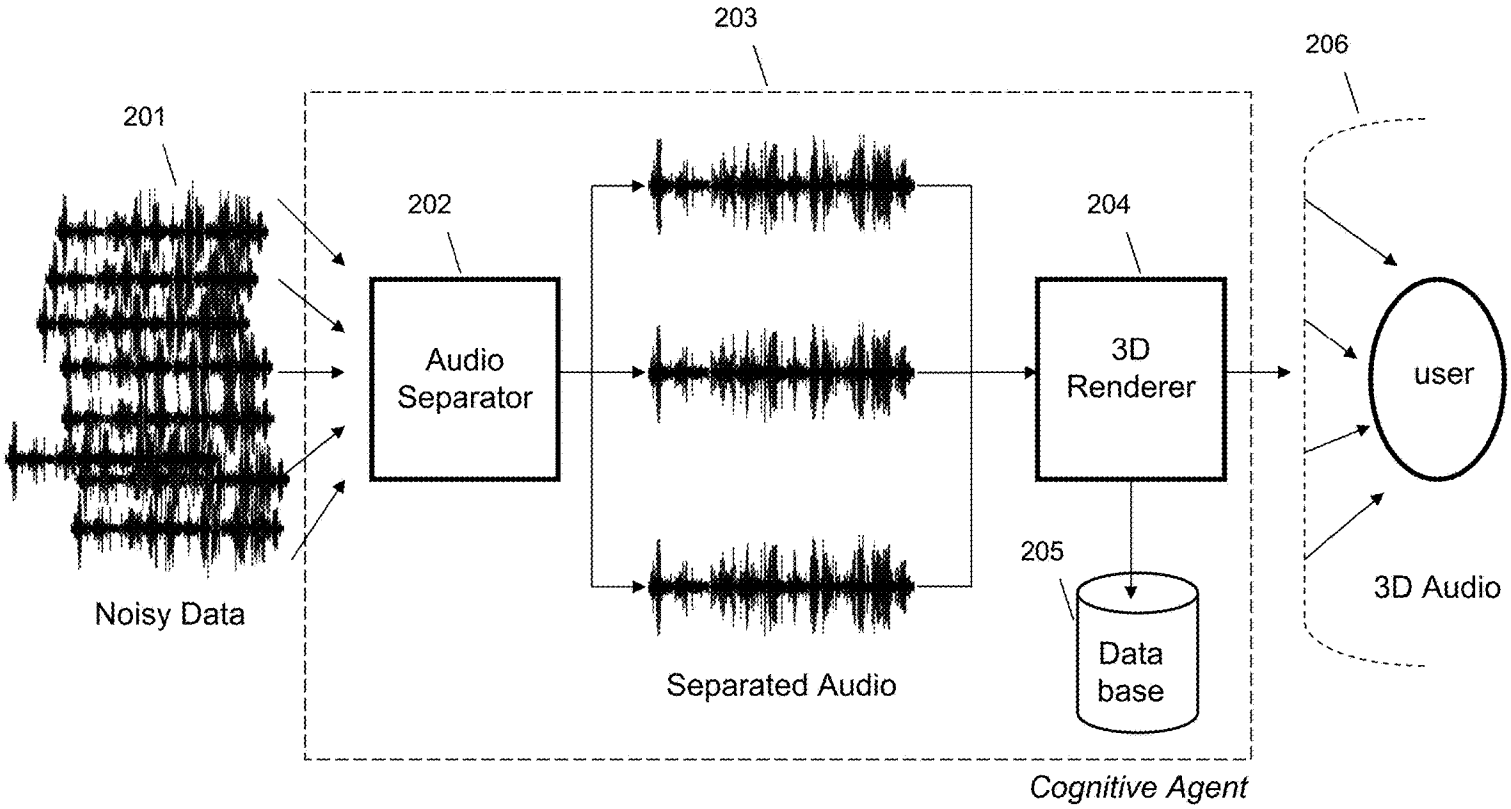
FIG. 2 schematically illustrates an audio separation and rendering.

Referring now to FIG. 2, an embodiment receives noisy data at 201. Typically, this noisy data originates from a large number of sources. However, noisy audio can be created with a minimum of two sources. This initial audio content is typically gathered from different environmental sources (e.g., multiple people speaking, waves on a beach, wind, automobile traffic, etc.) through a microphone array like that shown in FIG. 1 at 102. Once the initial noisy data 201 is received at the cognitive agent, it is passed to an audio separator at 202.

In a further embodiment, the audio separator 202 receives the noisy audio and performs a real-time source separation. The audio separator 202 may use any audio source separation technique (e.g., local nonlinear least-squares (NLS), iterative sinusoidal modeling, discrete Fourier transform (DFT), blind source separation, etc.). Once the audio separator is successful, the separated audio 203 is passed to a 3D renderer at 204. The 3D render then renders the audio into a 3D spatial sound which can be passed to an audio output device (e.g., the noise cancelling headphones shown in FIG. 1 at 101) and played to the user at 206.

In an additional embodiment, a database is utilized at 205. The database stores relevant information that the cognitive agent can use during audio selection. The cognitive agent is designed based on typical human abilities when attempting to determine which of the multiple audio sources to focus on (i.e., it considers factors that a typical human would consider when making a determination). In an embodiment, the cognitive agent may consider visual, auditory, or tactile information. This information is then stored in the database at 205.

Figure 3:
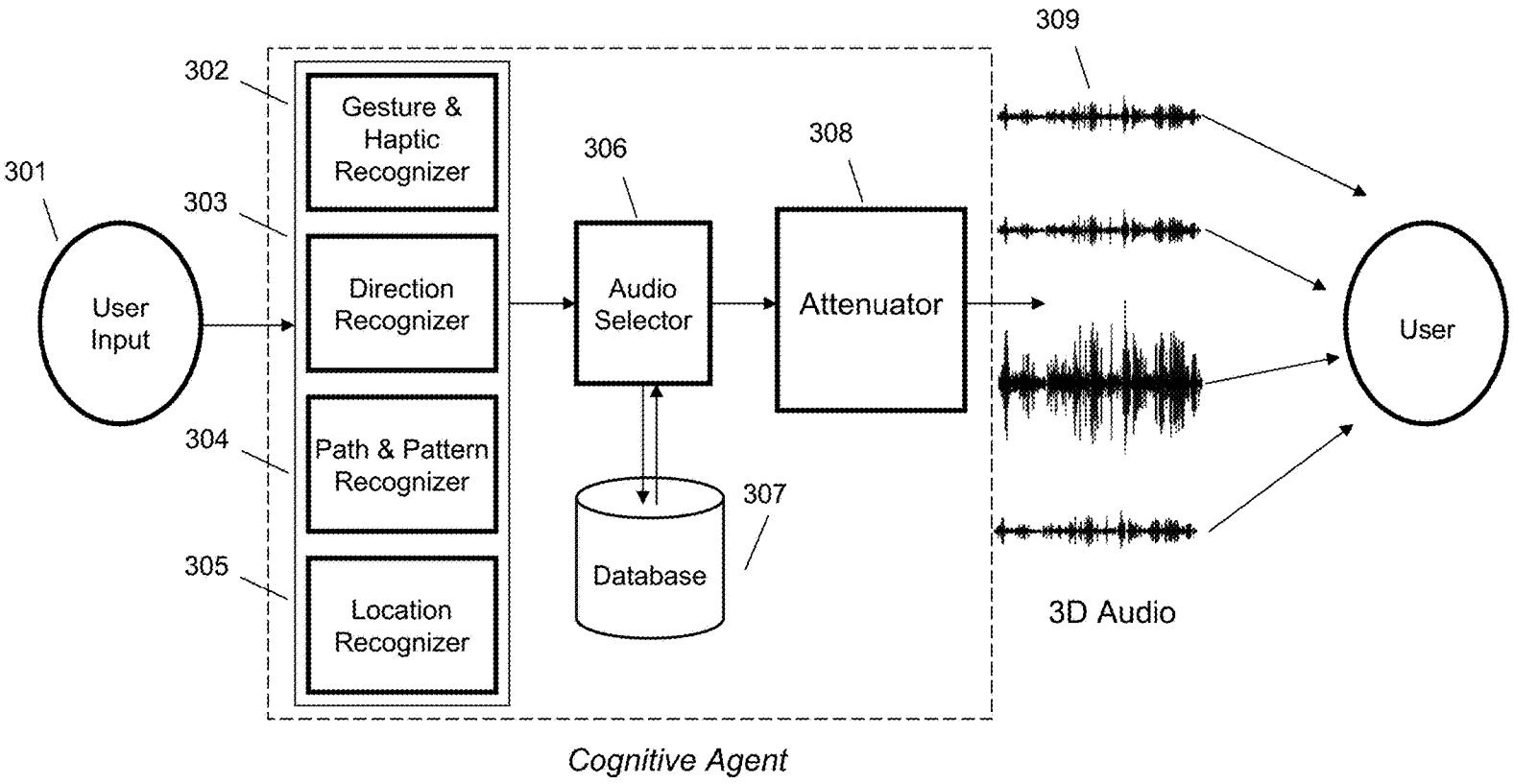
FIG. 3 schematically illustrates an adaptive cognitive agent.

Referring now to FIG. 3, an embodiment utilizes a cognitive agent. The artificial cognitive agent is based on computational cognitive modeling and can analyze the different audio sources, and if required give recommendations to a user. In an embodiment, the cognitive agent receives input at 301 (e.g., gesture movement, user movement, location data, etc.). This input 301 is utilized by the audio selector 306, after separation, to determine which individual audio streams to attenuate or amplify based on the input 301.

This selection of audio source 306 is done based on an array of factors, such as gesture or haptic recognition at 302. Gesture recognition enables a user to input information in an effortless manner. For example, in an embodiment, the noise cancelling headphones include a motion sensor device, thus a user could nod toward a desired audio source, thereby indicating his or her intent to select it as the desired audio source. Alternatively, the user could select a desired audio source using haptic or manual selection. By way of example, a graphical user interface (GUI) could be displayed on a display device (e.g., a smart phone, tablet, etc.) showing a reproduction of the user and allowing the user to select a direction or area in his or her proximity on the display to determine the desired audio source.

Once a selection is made by the user (e.g., using gesture, haptic, keyboard, mouse, or any I/O device) the selection is passed to the audio selector 306. Following the audio selection, the attenuator 308 determines which signals to attenuate and which to amplify at 309. In an additional embodiment, the input 301 may be received at a remote device, which can then communicate with the cognitive agent (e.g., via Wi-Fi, near field communication, physical cable, etc.). By way of example, a user may be utilizing any type of wearable technology (e.g., as a fitness tracker, smart glasses, etc.), and thus may input gesture control with the flick of a wrist or turning their head to visually focus on the audio source at 302.

Additionally or alternatively, the selection of the audio source at 306 can be determined based on a direction recognizer at 303. Utilizing the direction recognizer, the cognitive agent can process all the received audio signals, once separate, and determine the different audio sources with respect to the location of the user. Thus, once the user begins movement in any direction, the direction recognizer at 303 can determine which audio sources the user is moving toward or away from. By way of example, an embodiment may determine that a user is walking toward an audio source and interpret that action (the direction of travel) as indicating the user's auditory focus. Therefore the cognitive agent can, based on the directional recognizer, determine that the audio signal in the direction of user movement is the intended audio source and attenuate or amplify it accordingly.

The ability of the direction recognizer 303 to track the movement of a user through an area with multiple audio sources is based on the cognitive agent's spatially determined audio selector at 306. By determining the audio source spatially relative to the user, the cognitive agent can monitor all of the audio sources as a user moves through a space. By way of example, a large conference may have multiple vendor booths presenting short demonstrations, which create substantial background noise. However, if a user has selected a peer or co-worker as the desired audio source, the cognitive agent can suppress the remaining sources of audio input (e.g., the vendor displays), even as the user walks through the conference. Thus, although the distance between the user and each vendor varies as they walk, the cognitive agent can continue to attenuate the sound from the vendors based on the location of the audio source within the spatial recognition.

Additionally or alternatively, determining the audio selection can be done based on a path and pattern recognizer at 304. In an embodiment, the path and pattern recognizer allows a cognitive agent to learn from the user's habits and preferences. For example, if a user regularly visits an establishment that has live music and always selects the musical performance as his or her desired audio source, the path and pattern recognizer 304 can learn this pattern and accommodate the user automatically. These patterns and paths are stored in the cognitive agent's database at 307. In an embodiment, the database can contain any relevant historical user input 301 (e.g., location preferences, preferences for certain individuals, etc.). In a further example, an embodiment may determine that a specific person (e.g., a spouse, child, etc.) is typically selected by the user as the desired audio source. Thus, the cognitive agent can store that information in the database at 307 for future interactions with that individual.

Additionally or alternatively, the audio selection determining can be done based on a location recognizer at 305. In an embodiment, the location recognizer allows the cognitive agent to use a user's location as a factor in determining which audio source to select at 306. For example, the location of the user may determine certain environmental circumstances (e.g., is the user at a sporting event, train station, airport, etc.). As a specific example, if a user was located in an airport or train station, the cognitive agent may select the public address (PA) system as the desired audio source. The location recognizer can determine the location using any reasonable method (e.g., GPS, Glonass, Galileo, multilateration of radio signals between cellular towers, etc.). Additionally, the general location can also be used to measure high levels of movement (e.g., bus travel, train travel, etc.). Thus, if the cognitive agent determines the user is traveling by train it may once again select the PA system as the desired audio source to ensure the user does not miss their stop.

In an embodiment, once the audio has been selected at 306, and the attenuation and amplification is complete at 308, the audio undergoes 3D audio rendering at 309. The 3D audio is then presented to the user in form of 3D spatial audio, with variation in amplitude and directions, depending on the source. Thus, because the audio content is from the multiple sources in different locations, the user experience is enhanced by the audio being in the form of 3D spatial audio as that feels more natural. In an additional embodiment, the cognitive agent separates individual audio streams 306, and renders them in a 3D audio cloud, which is then played to the user through an audio delivery device (e.g., headphones as in FIG. 1 at 101) with a variation of amplitude and direction based upon the user input at 301.

Figure 4:
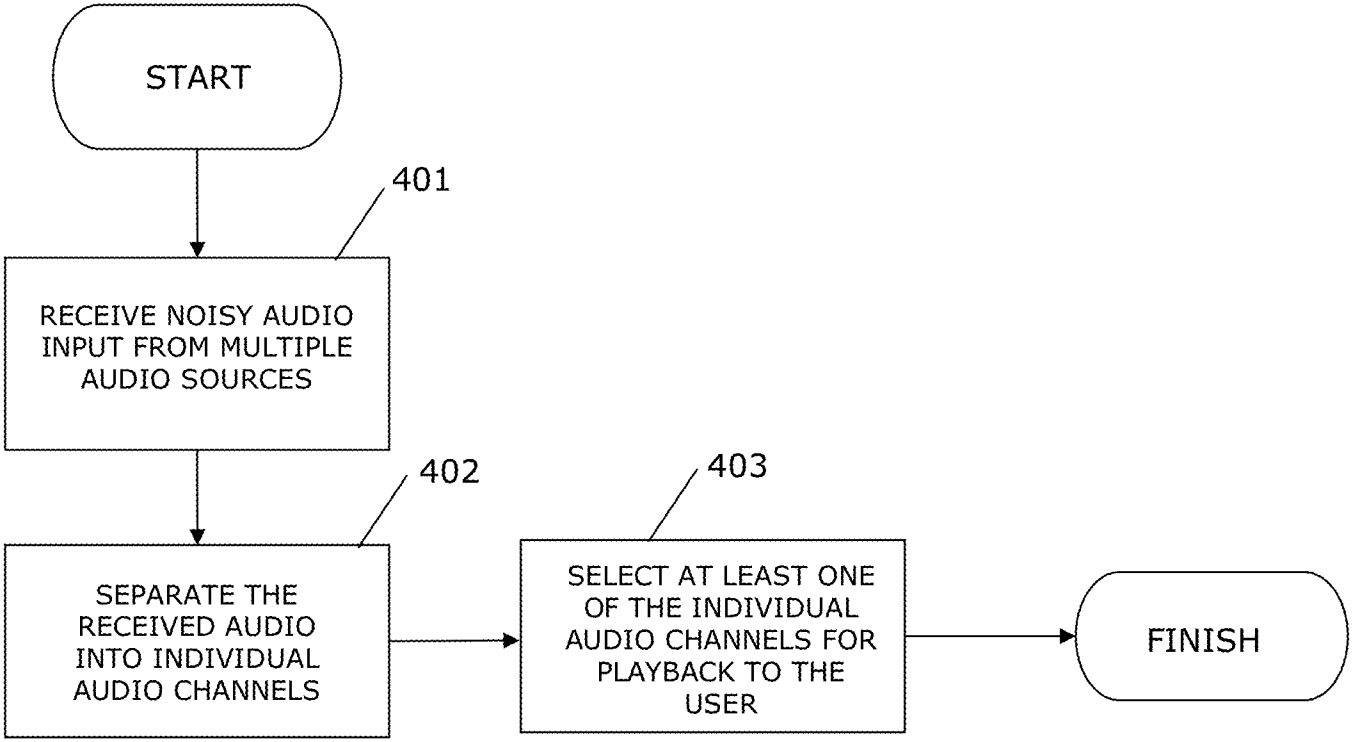
FIG. 4 sets forth a process more generally for filtering audio in a noisy environment.

Referring now to FIG. 4, an embodiment receives, using a plurality of audio input devices, audio input from a multiple of sources at 401. Once the audio data are received, an embodiment separates the noisy audio input into individual audio channels at 402. The separation of the audio channels is designated by the audio source and audio source location. An embodiment then selects at least one of the individual audio channels for delivery to a user at 403.

Figure 5:
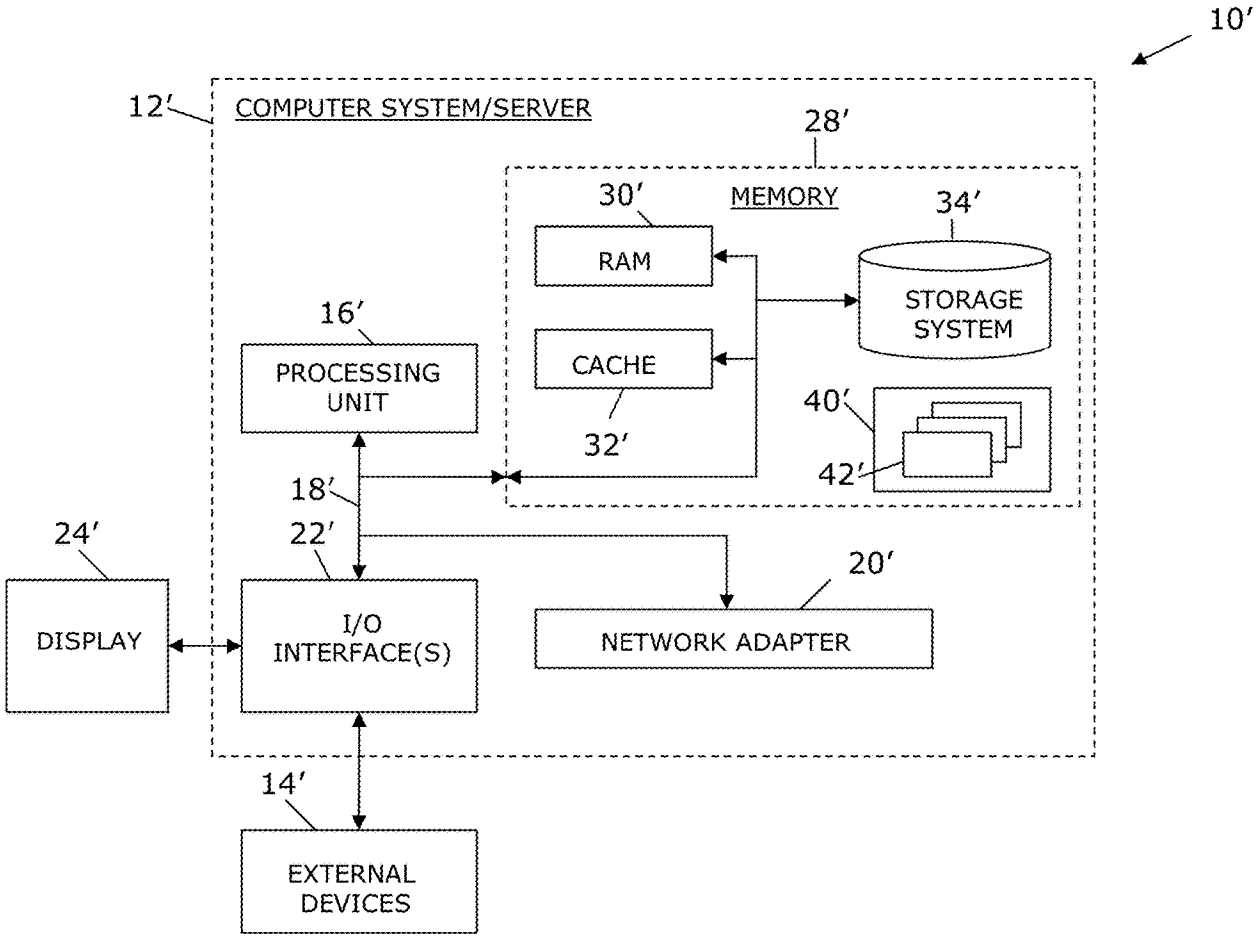
FIG. 5 illustrates a computer system.

Referring now to FIG. 5, a schematic of an example of a computing node is shown. Computing node 10' is only one example of a suitable computing node and is not intended to suggest any limitation as to the scope of use or functionality of embodiments of the invention described herein. Regardless, computing node 10' is capable of being implemented and/or performing any of the functionality set forth hereinabove. In accordance with embodiments of the invention, computing node 10' may be part of a cloud network or could be part of another type of distributed or other network (e.g., it could represent an enterprise server), or could represent a stand-alone node.

In computing node 10' there is a computer system/server 12', which is operational with numerous other general purpose or special purpose computing system environments or configurations. Examples of well-known computing systems, environments, and/or configurations that may be suitable for use with computer system/server 12' include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12' may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12' may be practiced in distributed cloud computing environments where tasks are performed by remote processing devices that are linked through a communications network. In a distributed cloud computing environment, program modules may be located in both local and remote computer system storage media including memory storage devices.

As shown in FIG. 4, computer system/server 12' in computing node 10' is shown in the form of a general-purpose computing device. The components of computer system/server 12' may include, but are not limited to, at least one processor or processing unit 16', a system memory 28', and a bus 18' that couples various system components including system memory 28' to processor 16'. Bus 18' represents at least one of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12' typically includes a variety of computer system readable media. Such media may be any available media that are accessible by computer system/server 12', and include both volatile and non-volatile media, removable and non-removable media.

System memory 28' can include computer system readable media in the form of volatile memory, such as random access memory (RAM) 30' and/or cache memory 32'. Computer system/server 12' may further include other removable/non-removable, volatile/non-volatile computer system storage media. By way of example only, storage system 34' can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18' by at least one data media interface. As will be further depicted and described below, memory 28' may include at least one program product having a set (e.g., at least one) of program modules that are configured to carry out the functions of embodiments of the invention.

Program/utility 40', having a set (at least one) of program modules 42', may be stored in memory 28' (by way of example, and not limitation), as well as an operating system, at least one application program, other program modules, and program data. Each of the operating systems, at least one application program, other program modules, and program data or some combination thereof, may include an implementation of a networking environment. Program modules 42' generally carry out the functions and/or methodologies of embodiments of the invention as described herein.

Computer system/server 12' may also communicate with at least one external device 14' such as a keyboard, a pointing device, a display 24', etc.; at least one device that enables a user to interact with computer system/server 12; and/or any devices (e.g., network card, modem, etc.) that enable computer system/server 12' to communicate with at least one other computing device. Such communication can occur via I/O interfaces 22'. Still yet, computer system/server 12' can communicate with at least one network such as a local area network (LAN), a general wide area network (WAN), and/or a public network (e.g., the Internet) via network adapter 20'. As depicted, network adapter 20' communicates with the other components of computer system/server 12' via bus 18'. It should be understood that although not shown, other hardware and/or software components could be used in conjunction with computer system/server 12'. Examples include, but are not limited to: microcode, device drivers, redundant processing units, external disk drive arrays, RAID systems, tape drives, and data archival storage systems, etc.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure.

Although illustrative embodiments of the invention have been described herein with reference to the accompanying drawings, it is to be understood that the embodiments of the invention are not limited to those precise embodiments, and that various other changes and modifications may be affected therein by one skilled in the art without departing from the scope or spirit of the disclosure.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions. These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A method of filtering audio in a noisy environment, said method comprising:

utilizing at least one processor to execute computer code that performs the steps of:

receiving, at a location of a user and by at least one microphone operatively coupled to noise cancelling headphones, an audio input comprising combined audio input of a plurality of audio signals, each generated by an environmental audio source, wherein each of the environmental audio sources are in proximity to the user;

after receipt of the audio input, separating the audio input into a plurality of audio streams, wherein each of the audio streams corresponds to one of the environmental audio sources;

modifying at least one of the audio streams in response to a user selection, wherein the user selection identifies at least one of the environmental audio sources as a source of focus and wherein the modifying at least one of the audio streams comprises adjusting an amplitude of the audio streams corresponding to the audio sources; and providing, at the noise cancelling headphones, audio output of the at least one audio stream corresponding to the at least one of the environmental audio sources identified as a source of focus, wherein the provided audio output comprises a three-dimensional spatial sound rendered from the audio input selected as a source of focus.

2. The method according to claim 1, wherein the user selection is based upon user input comprising at least one of: gesture input, haptic input, keyboard input, and mouse input.

3. The method according to claim 1, wherein the user selection is based upon a location of the plurality of audio input devices.

4. The method according to claim 1, wherein the user selection is based upon a direction in which the plurality of audio input devices is moving relative to the audio sources.

5. The method according to claim 1, wherein the user selection is made utilizing stored previous user selection data.

6. The method according to claim 1, comprising:

rendering, using the processor, the audio into 3D spatial sound.

7. The method according to claim 1, comprising:

receiving at least one additional audio input from at least one additional audio source; and separating the additional audio from the previously separated audio into the additional source in response to a user selection.

8. The method according to claim 1, wherein the adjusting an amplitude comprises amplifying the audio stream corresponding to the identified at least one of the sources and attenuating the remaining audio streams corresponding to the remaining sources.

9. An apparatus for filtering audio in a noisy environment said apparatus comprising:

at least one processor;

a plurality of audio input devices; and a computer readable storage medium having computer readable program code embodied therewith and executable by the at least one processor, the computer readable program code comprising:

computer readable program code that receives, at a location of a user and by at least one microphone operatively coupled to noise cancelling headphones, an audio input comprising combined audio input of a plurality of audio signals, each generated by an environmental audio source, wherein each of the environmental audio sources are in proximity to the user;

computer readable program code that, after receipt of the audio input, separates the audio input into a plurality of audio streams, wherein each of the audio streams corresponds to one of the environmental audio sources;

computer readable program code that modifies at least one of the audio streams in response to a user selection, wherein the user selection identifies at least one of the environmental audio sources as a source of focus and wherein the modifying at least one of the audio streams comprises adjusting an amplitude of the audio streams corresponding to the audio sources; and computer readable program code that provides, at the noise cancelling headphones, audio output of the at least one audio stream corresponding to the at least one of the environmental audio sources identified as a source of focus, wherein the provided audio output comprises a three-dimensional spatial sound rendered from the audio input selected as a source of focus.

10. A computer program for filtering audio in a noisy environment, said computer program product comprising:

a computer readable storage medium having computer readable program code embodied therewith, the computer readable program code comprising:

computer readable program code that receives, at a location of a user and by at least one microphone operatively coupled to noise cancelling headphones, an audio input comprising combined audio input of a plurality of audio signals, each generated by an environmental audio source, wherein each of the environmental audio sources are in proximity to the user;

computer readable program code that, after receipt of the audio input, separates the audio input into a plurality of audio streams, wherein each of the audio streams corresponds to one of the environmental audio sources;

computer readable program code that modifies at least one of the audio streams in response to a user selection, wherein the user selection identifies at least one of the environmental audio sources as a source of focus and wherein the modifying at least one of the audio streams comprises adjusting an amplitude of the audio streams corresponding to the audio sources; and computer readable program code that provides, at the noise cancelling headphones, audio output of the at least one audio stream corresponding to the at least one of the environmental audio sources identified as a source of focus, wherein the provided audio output comprises a three-dimensional spatial sound rendered from the audio input selected as a source of focus.

11. The computer program product according to claim 10, wherein the user selection is based upon user input comprising at least one of: gesture input, haptic input, keyboard input, and mouse input.

12. The computer program product according to claim 10, wherein the user selection is based upon a location of the plurality of audio input devices.

13. The computer program product according to claim 10, wherein the user selection is based upon a direction in which the plurality of audio input devices is moving relative to the audio sources.

14. The computer program product according to claim 10, wherein the user selection is made utilizing stored previous user selection data.

15. The computer program product according to claim 10, wherein the computer readable program code comprises:

computer readable program code that renders the audio into 3D spatial sound.

16. The computer program product according to claim 10, wherein the computer readable program code comprises:

computer readable program code that receives at least one additional audio input from at least one additional audio source; and computer readable program code that separates the additional audio from the previously separated audio into the additional source in response to a user selection.

17. The computer program product according to claim 10, wherein the adjusting an amplitude comprises amplifying the audio stream corresponding to the identified at least one of the sources and attenuating the remaining audio streams corresponding to the remaining sources.

18. A method comprising:

receiving, at a location of a user by at least one microphone operatively coupled to noise cancelling headphones, an audio input comprising combined audio input of a plurality of audio signals, each generated by an environmental audio source, wherein each of the plurality of environmental audio sources are in proximity to the user;

after receipt of the audio input, separating the audio input into a plurality of audio streams, wherein each of the audio streams corresponds to one of the environmental audio sources in response to a user selection;

receiving at least one additional audio input from at least one additional environmental audio source;

separating the additional audio into the additional environmental audio source in response to a user selection, wherein the user selection identifies at least one of the environmental audio sources as a source of focus;

adjusting, based on the selection, an amplitude of the audio streams corresponding to the environmental audio sources, wherein the adjusting comprises amplifying the audio stream corresponding to the identified at least one of the environmental audio sources and attenuating the remaining audio streams corresponding to the remaining environmental audio sources; and providing, at the noise cancelling headphones, audio output of the at least one audio stream corresponding to the at least one of the environmental audio sources identified as a source of focus, wherein the provided audio output comprises a three-dimensional spatial sound rendered from the audio input selected as a source of focus.

19. The method of claim 1, wherein the user selection is identified using a cognitive agent that receives input from a user and identifies an intent of the user from the received input and maps the identified intent to a user selection.

20. The computer program product according to claim 10, wherein the user selection is identified using a cognitive agent that receives input from a user and identifies an intent of the user from the received input and maps the identified intent to a user selection.

* * * * *